US008910347B1

(12) United States Patent
Wilcox

(10) Patent No.: US 8,910,347 B1
(45) Date of Patent: Dec. 16, 2014

(54) RUBBER STRAP DEVICE

(71) Applicant: Alliance Rubber Company, Hot Springs, AR (US)

(72) Inventor: Brian Wilcox, Pearcy, AR (US)

(73) Assignee: Alliance Rubber Company, Hot Springs, AR (US)

( * ) Notice: Subject to any disclaimer, the term of this patent is extended or adjusted under 35 U.S.C. 154(b) by 0 days.

(21) Appl. No.: 13/916,718

(22) Filed: Jun. 13, 2013

Related U.S. Application Data

(60) Provisional application No. 61/658,981, filed on Jun. 13, 2012.

(51) Int. Cl.
*B65D 63/00* (2006.01)
*B65D 63/10* (2006.01)

(52) U.S. Cl.
CPC ..... *B65D 63/1027* (2013.01)
USPC ..... 24/16 R; 24/265 EC; 24/30.5 R; 24/300

(58) Field of Classification Search
USPC .... 24/16 R, 30.5 R, 265 EC, 265 CD, 265 C, 24/300, 265 AL, 302, 130
See application file for complete search history.

(56) References Cited

U.S. PATENT DOCUMENTS

| | | | | |
|---|---|---|---|---|
| 3,721,750 | A | 3/1973 | Countryman | |
| 4,158,250 | A | 6/1979 | Ringwald | |
| 4,237,174 | A | 12/1980 | Lagardere et al. | |
| 4,335,490 | A | 6/1982 | Teachout | |
| 4,406,042 | A | 9/1983 | McPhee | |
| 4,428,099 | A | 1/1984 | Richmond | |
| 4,569,108 | A | 2/1986 | Schwab | |
| 4,689,858 | A | 9/1987 | Barber | |
| 4,762,318 | A | 8/1988 | Phillips et al. | |
| 4,910,835 | A | 3/1990 | Carpenter | |
| 4,991,265 | A | 2/1991 | Campbell et al. | |
| 5,081,746 | A | 1/1992 | Czwartacki | |
| 5,123,913 | A | 6/1992 | Wilk et al. | |
| 5,195,218 | A | 3/1993 | Joseph et al. | |
| 5,199,135 | A | 4/1993 | Gold | |
| 5,232,193 | A | 8/1993 | Shakoon | |
| 5,325,568 | A | 7/1994 | Bruhm | |
| 5,524,327 | A | 6/1996 | Mickel et al. | |
| 5,531,418 | A | 7/1996 | Lindgren | |
| 5,592,718 | A | 1/1997 | Mohr | |
| 5,715,578 | A | 2/1998 | Knudson | |
| 5,852,851 | A | 12/1998 | Cooper | |
| 5,987,707 | A | 11/1999 | DeShon | |
| 5,996,204 | A | 12/1999 | Norwood | |
| 6,195,846 | B1 | 3/2001 | Studdiford et al. | |
| 6,226,839 | B1 | 5/2001 | Sayegh | |
| 6,543,094 | B2 | 4/2003 | D'Addario | |
| 6,637,595 | B1 | 10/2003 | Forssard et al. | |
| 6,683,258 | B1 | 1/2004 | Tracy et al. | |
| 6,842,948 | B2 | 1/2005 | Smith | |
| 7,588,216 | B1 | 9/2009 | Hoyl | |
| 8,046,878 | B1 * | 11/2011 | Matrejek | 24/30.5 L |
| 8,399,769 | B2 | 3/2013 | Doll | |

* cited by examiner

*Primary Examiner* — Robert J Sandy
*Assistant Examiner* — Rowland Do
(74) *Attorney, Agent, or Firm* — Renner, Kenner, Greive, Bobak, Taylor & Weber

(57) ABSTRACT

A rubber strap device is provided that includes a post that may be selectively attached to a flexible strap for securing the ends of the flexible strap when the strap is wrapped around one or more objects. The post may be configured to maintain a selected position on the flexible strap when mounted thereon.

7 Claims, 2 Drawing Sheets

RUBBER STRAP DEVICE

TECHNICAL FIELD

Embodiments of the present invention relate to a rubber strap device. More specifically, embodiments of the invention relate to a rubber strap device that selectively joins end loops in a flexible strap and that may be positioned about one or more object.

BACKGROUND OF THE INVENTION

Elastomeric bands have long been employed to bundle or otherwise organize one or more objects. Typically, these bands are used to organize objects such as: computer cables and cords, telephone system cords, power tool cords, building materials, automotive parts, jumper cables, gardening stakes, plants, appliance cords, extension cords, decorative lights, skies and poles, fishing equipment, boating lines, camping equipment and sleeping bags. The most common use of such bands is to stretch the band over a plurality of items to hold them together or double-up the band, when the length of the elastomeric band prevents it from holding items snugly together. In this instance, the objects pass through the loop or loops defined by the band.

An alternative use of elastomeric bands is to create a loop, when organizing objects, by securing the ends of the band together. Since the ends of the band cannot be readily attached or secured to each other, it is known to employ a dowel pin or "handle" to join the ends of the band. In this process, the dowel is typically used to prevent the ends of the elastomeric band from coming apart. The combination of the elastomeric band and dowel incorporating this type of attachment are often referred to as binding devices or binder ties.

In one such binding device, the elastomeric band is wrapped around a bundle such that the ends are brought into an opposing relation with each other. Then, a first end of the loop is passed through a second end of the loop. The band may be pulled tight against the bundle by pulling the first end back against itself. The dowel pin is then inserted through the first loop, which is free, to prevent the first loop from withdrawing through the second loop. To function properly, the bands are generally sized and/or wrapped in such a way that the dowel is held in tension. In this way, the axial length of the dowel, which is generally longer than any opening created by the second end of the band, when the band is in tension, bears against the elastomeric band, preventing the dowel and thus the first loop from withdrawing through the second loop.

In one such device, the dowel was provided with a tapered end to facilitate insertion of the dowel in the end of the band allowing the band to be stretched onto a generally cylindrical portion of the dowel. This portion of the dowel, however, was smooth and offered no axial restraint to keep the band on the dowel. In some instances, the band would roll, slide or otherwise move axially to a point where the end of the band came free of the dowel. To prevent this disengagement, another design, functioning in the same way, incorporated a circumferential open notch formed centrally of the dowel to restrict axial movement of the band. In this design, the first end is threaded through the second end, as in the previous design, but, when the dowel is inserted, the first end of the band is placed within the notch such that the walls of the notch tend to prevent the end of the band from sliding off of the dowel. While these designs are successful in organizing a bundle, they are somewhat inefficient in that the process of bundling requires several steps, namely, encircling the bundle, passing one end of the band through the other, and inserting the dowel. Further, the end of the band may slide off the dowel when the bundle is subject to distortion during movement or handling.

Recognizing these deficiencies, efforts have been made to affix a handle to the elastomeric band, such that when wrapping the elastomeric band around a bundle, the free end of the band is simply stretched over the handle end. To affix the handle to the loop, one design incorporated an axial slot extending through the handle. One end of the elastomeric band is threaded through the slot, such that a looped portion of the end extends beyond the handle. A pin having a greater axial extent than that of the slot is then inserted through the extending loop to preclude the extending loop from returning through the slot. Recessed notches were formed adjacent either end of the slot for receiving the ends of the pin, thereby allowing the pin to be recessed within the body of the handle. The elastomeric band was then pulled tight against the pin to hold the pin within the recessed notches. This design relied on the force of the band against the pin to hold the pin within the recess. In most uses, the band is suitably tensioned to hold the pin fast, but, in some instances, the pin may fall out allowing the band to withdraw from the notch in the handle. At this point, the band is no longer secured to itself and fails to hold the bundle. Also, when not in use, the pin may fall out because the band is slack with no force being applied to hold the pin in the notches. Since the pin used to secure the dowel to the end of the elastomeric band is typically small, when it comes free of the handle, it is easily lost. If the pin is lost, the handle cannot be used to couple the ends of the loop. At this point, the user must endeavor to obtain a substitute pin or purchase additional binder ties.

SUMMARY OF THE INVENTION

An object of the present invention is to provide a rubber strap device including a post that may be selectively attached to a circular rubber band, or ring, for securing the ends of the rubber band when wrapped around one or more objects. One or more embodiments of the present invention provides a rubber strap device including a rubber strap and a mountable post that may be configured to maintain a selected position on the rubber strap when mounted thereon.

One or more embodiments of the present invention further provide a rubber strap device that is a one-piece configuration without easily separable parts that could be lost or misplaced or accidentally separated during utilization. In one or more embodiments, the rubber strap device includes a rubber strap and a two-part post, which can be readily molded of plastic material, which is durable and can be repeatedly reused, and which is relatively inexpensive. One or more embodiments of the present invention provides a rubber strap device for securing objects, the device comprising a post having an elongated body with prongs extending from said body, each prong terminating in a notched tab, said prongs defining a slot for receiving widthwise a portion of an elastomeric band, and a tubular retaining sleeve encircling said prongs and engaged with said notched tabs, and an elastomeric band having a first end that is threaded through said slot of said post and held in place by said retaining sleeve, and a second end that may be wrapped around one or more objects and coupled to said first end of said strap by inserting said post through said second end, thereby securing said objects.

DETAILED DESCRIPTION OF THE INVENTION

Figure 1:
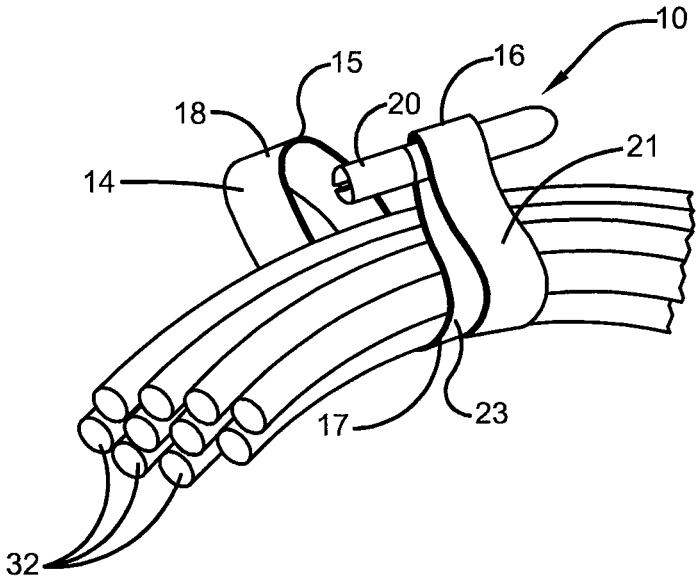
FIG. 1 is a perspective view of a rubber strap device according to the present invention, depicting a first end of the rubber strap inserted into the post, with the tubular sleeve in place.

A rubber strap device according to the concepts of the present invention is depicted in the figures, where it is generally referred to by the numeral 10. In FIG. 1, device 10 is shown to include rubber strap 14. Rubber strap 14 includes a first end 16 and a second end 18, first and second sides 21, 23 extending between the first and second ends 16 and 18 forming a continuous band of material. First edge 15 and second edge 17 extend between first and second sides 21, 23 and the thickness of the strap $W_T$ generally corresponds to the length of the edge, i.e. the distance from side 21 to side 23. Elastomeric bands of this configuration are flexible, and are commonly made of a variety of elastomeric compounds in a wide variety of different sizes. For purposes of this disclosure, the term "rubber" refers to a flexible rubbery material, and is meant to include a wide variety of natural and synthetic elastomeric compounds.

As shown in FIG. 1, device 10 also includes post 20. Post 20 generally includes a body 22, prongs 24, 25, and a retaining sleeve 26. Body 22 may be generally elongated. Prongs 24, 25 extend axially from body 22, and define slot 28. Prongs 24, 25 define a smaller circumference than body 22, and terminate in notched tabs 27, 29, which function to prevent retaining sleeve 26 from sliding off of prongs 24, 25. More specifically, the axial length of prongs 24, 25 from body 22 to notched tabs 27, 29 is very close to the same as the axial length of sleeve 26. Moreover, the circumference of body 22 is very close to the circumference of sleeve 26.

Figure 2:
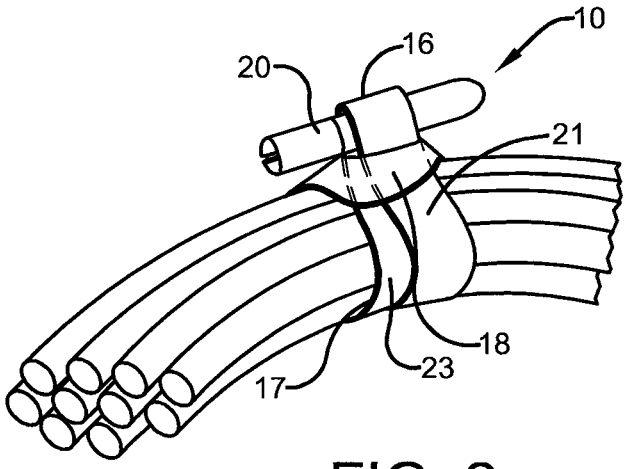
FIG. 2 is a perspective view similar to FIG. 1, depicting the rubber strap device where the post and strap have been placed in a secured position with the post and first end past through the second end of the rubber strap and oriented to prevent the post from withdrawing through the second end.

As shown in FIG. 1, post 20 may be attached to one end of the strap, in this case first end 16 of strap 14. The free end of strap 14, in this case second end 18, may be wrapped around one or more objects 32, such as the several cylindrical strands of material shown for exemplary purposes in FIGS. 1 and 2, to organize or secure objects 32. The strap 14 is coupled end-to-end by inserting post 20 carrying first end 16, in button-hole or other fashion, through second end 18 to attain a secured position (FIG. 2). To prevent withdrawal of the first end 16 from second end 18, the post 20 may be of any suitable dimensions, paying to attention to the size of the straps 14 and the posts ability to resist bending forces imparted by the strap 14.

Figure 3:
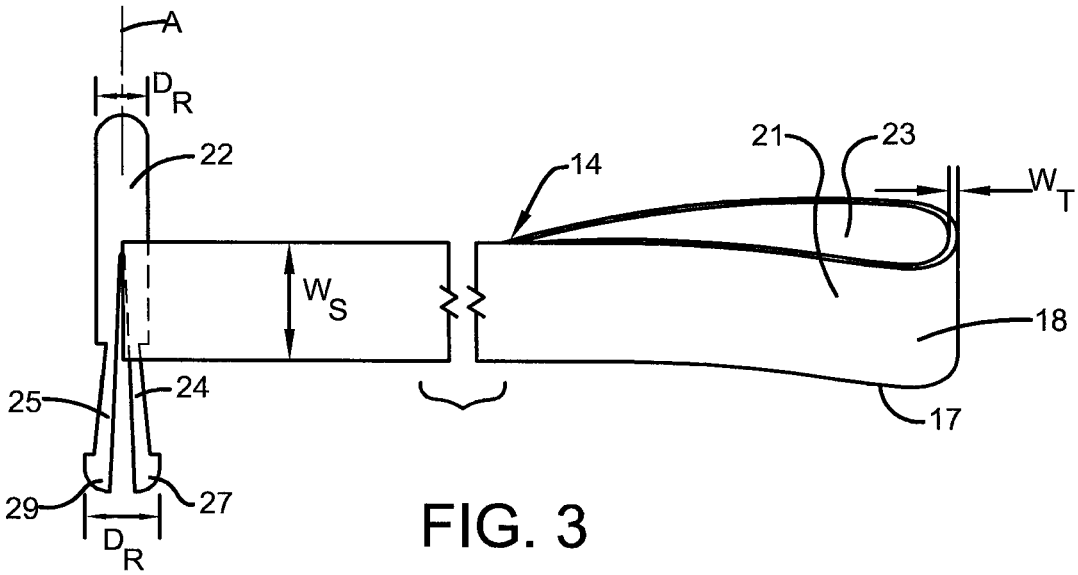
FIG. 3 is a top elevational view of a post and rubber strap according to the present invention, with the tubular sleeve removed.

Device 10 is further illustrated in FIG. 3, where it is not in use, and is shown without sleeve 26 in place. In one embodiment, strap 14 may include a fixed or adjustable juncture where two points of strap 14 come together and define a loop. In other embodiments, there is no such juncture.

Figure 4:
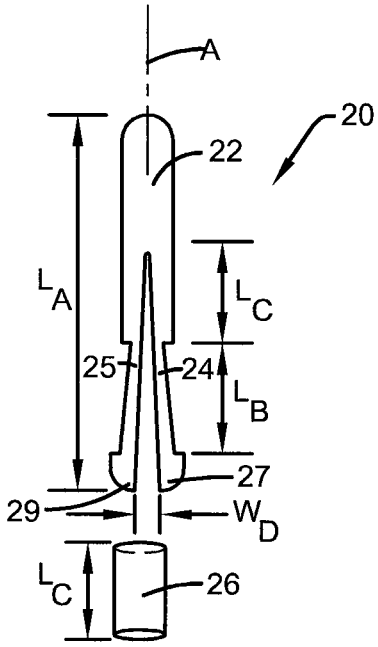
FIG. 4 is a top elevational view of a post according to the present invention, disassembled to show the tubular sleeve apart from the remaining portion of the post.

Post 20 is further illustrated in FIG. 4, without strap 14, and in what can be referred to as an open position, i.e. with sleeve 26 removed from prongs 24, 25.

To prevent post 20 from easily sliding along strap 14, slot 28 may have a width $W_D$ that is very close to or even slightly less than the thickness $W_T$ of strap 14. For example, to accommodate straps having a thickness $W_T$ of about 0.060 to about 0.075 inches, slot 28 may have a width $W_D$ that is about 0.040 to about 0.075 inches.

Figure 5:
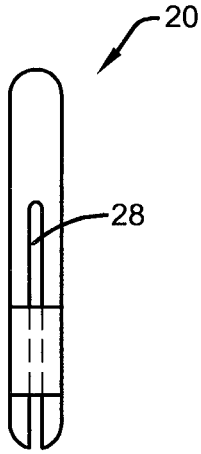
FIG. 5 is a top elevational view of a post according to the present invention, assembled.

Slot 28 extends into body 22 a distance $L_C$ that is approximately equal to the width $W_s$ of strap 14. Post 20 is further illustrated in FIG. 5, in what can be referred to as a closed position, i.e. with sleeve 26 in place and encircling prongs 24, 25. As shown in FIG. 5, post 20 is attached to strap 14, by inserting first edge 15 or second edge 17 of strap 14 into slot 28. When strap 14 has been moved all the way to the far end of slot 28, sleeve 26 is slid over prongs 24, 25 until locked into place by notched tabs 27, 29.

It should be apparent from the above description and the appended Figures that the present invention provides a rubber strap device including a post that may be selectively attached to a rubber band for securing the ends of the rubber band when wrapped around one or more objects, and that the post may be configured to maintain a selected position on the rubber strap when mounted thereon.

I claim:

1. A rubber strap device for securing objects, the device comprising:

a post having an elongated body with prongs extending from an axial end of said body, each prong terminating in an outwardly extending tab formed with a notch, said prongs defining a slot for axially receiving widthwise a portion of an elastomeric band, and a tubular retaining sleeve encircling said prongs and axially engaging said notches of said tabs, and an elastomeric circular band having a first end that is threaded through said slot of said post and held in place by said retaining sleeve, and a second end that may be wrapped around one or more objects and coupled to said first end of said elastomeric band by inserting said post through said second end to secure the objects.

2. The device of claim 1, wherein said body has a circumference and said prongs define a circumference, and wherein the circumference that is defined by said prongs is smaller than the circumference of the body.

3. The device of claim 1, said prongs having an axial length from said body to said tabs, and said sleeve having an axial length that is approximately equal to the axial length of said prongs.

4. The device of claim 1, said body having a circumference and said sleeve having a circumference that is approximately equal to the circumference of said body.

5. The device of claim 1, said elastomeric band having a thickness $W_T$ of from about 0.060 to about 0.075 inches, and said slot having a width $W_D$ of about 0.040 to about 0.075.

6. The device of claim 1, wherein said slot extends into said body a distance $L_C$, and wherein said strap has a width $W_S$ that is approximately equal to said distance $L_C$.

7. The device of claim 1, wherein said elastomeric band is coupled end-to-end by inserting said post carrying said first end, in button-hole fashion, through said second end to attain a secured position.

* * * * *